US009512978B1

(12) United States Patent
Wimberly

(10) Patent No.: US 9,512,978 B1
(45) Date of Patent: Dec. 6, 2016

(54) VORTEX LIGHT PROJECTION SYSTEM, LED LENSLESS PRIMARY OPTICS SYSTEM, AND PERFECTLY RANDOM LED COLOR MIXING SYSTEM

(71) Applicant: Randal L Wimberly, Elizabethtown, IL (US)

(72) Inventor: Randal L Wimberly, Elizabethtown, IL (US)

( * ) Notice: Subject to any disclaimer, the term of this patent is extended or adjusted under 35 U.S.C. 154(b) by 0 days.

(21) Appl. No.: 14/826,186

(22) Filed: Aug. 13, 2015

(51) Int. Cl.

| | |
|---|---|
| ***F21V 7/22*** | (2006.01) |
| ***F21V 7/04*** | (2006.01) |
| ***F21V 29/70*** | (2015.01) |
| *F21Y 101/02* | (2006.01) |

(52) U.S. Cl.
CPC ..... *F21V 7/041* (2013.01); *F21V 7/22* (2013.01); *F21V 29/70* (2015.01); *F21Y 2101/02* (2013.01)

(58) Field of Classification Search
CPC ..... F21V 7/041; F21V 7/22; F21V 29/70
See application file for complete search history.

(56) References Cited

U.S. PATENT DOCUMENTS

| | | | | |
|---|---|---|---|---|
| 3,676,667 | A | 7/1972 | Malifaud | |
| 5,660,461 | A | 8/1997 | Ignatius et al. | |
| 6,155,699 | A | 12/2000 | Miller et al. | |
| 6,257,737 | B1 | 7/2001 | Marshall et al. | |
| 7,198,384 | B2 | 4/2007 | Kakiuchi et al. | |
| 7,293,906 | B2 | 11/2007 | Mok et al. | |
| 7,400,439 | B2 | 7/2008 | Holman | |
| 7,513,632 | B2 | 4/2009 | Kim et al. | |
| 7,520,642 | B2 | 4/2009 | Holman et al. | |
| 8,087,800 | B2 | 1/2012 | Bailey | |
| 8,104,929 | B2 | 1/2012 | Kovalchick et al. | |
| 8,113,680 | B2 | 2/2012 | O'Brien et al. | |
| 8,167,463 | B2 | 5/2012 | Loh | |
| 8,253,316 | B2 | 8/2012 | Sun et al. | |
| 8,362,509 | B2 | 1/2013 | Pickard et al. | |
| 8,395,310 | B2 | 3/2013 | Li | |
| 8,613,530 | B2 | 12/2013 | Allen et al. | |
| 8,967,821 | B2 | 3/2015 | Pickard | |
| 9,084,328 | B2 | 7/2015 | Negley et al. | |
| 2009/0231856 | A1* | 9/2009 | Householder | F21V 7/0025 362/304 |
| 2011/0292654 | A1* | 12/2011 | Haerle | F21K 9/00 362/235 |
| 2013/0188362 | A1* | 7/2013 | Howe | F21V 13/04 362/297 |
| 2014/0204586 | A1* | 7/2014 | Roberge | F21K 9/54 362/297 |

* cited by examiner

*Primary Examiner* — Thomas M Sember

(57) ABSTRACT

An improved primary optics light projection system comprising a cone shaped reflector designed within specified mathematical parameters and a light source placed near the apex focal point cross sectional area of said reflector is disclosed for projecting a vortex of light rays with a precise shape and an even beam field containing a maximum number of light rays produced by a light source having a small or large diameter or cross section. A reflector near the base of the light source and perpendicular to the cone shaped reflector and one or more lens may be included to increase efficiency. The cone shaped reflector may be made in various cross sectional shapes providing means for using light sources with a square, rectangular, round, oval, or unconventional shape allowing the use of high efficiency light sources such as, but not limited to, light emitting diodes, often used in clusters of multiple LEDs.

20 Claims, 13 Drawing Sheets

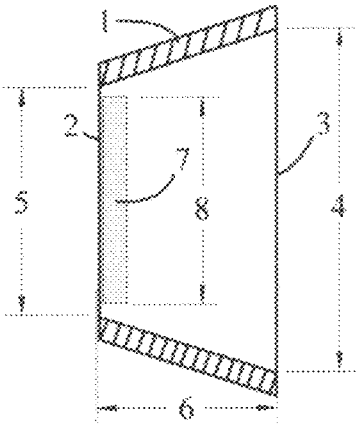
FIG. 1A
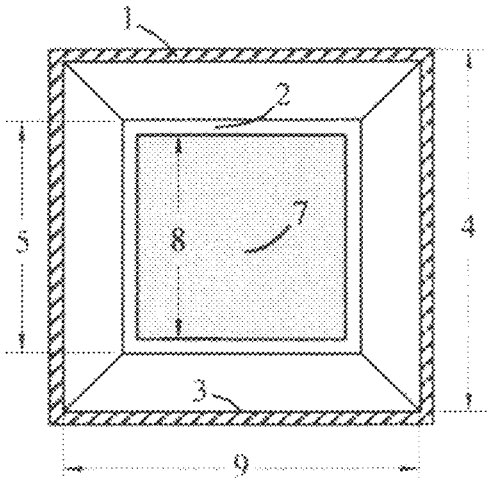
FIG. 1B
Formula definitions and parameters
to design cone shaped reflector
A is the apex focal point dimension
M is the cone mouth dimension
L is the cone length dimension
A=desired dimension of Apex
M= A x (not less than 1.6)
L= M x (not less than .5 and
not more than 7)
FIG. 1C
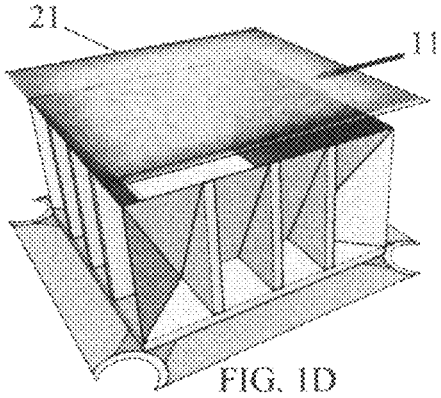
FIG. 1D
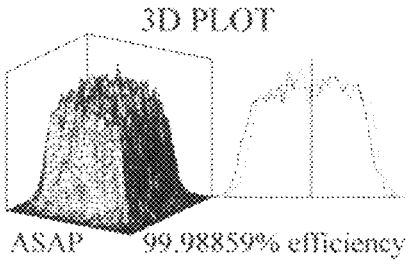
FIG. 1E
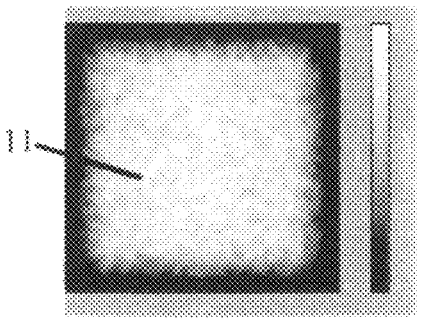
FIG. 1F

VORTEX LIGHT PROJECTION SYSTEM, LED LENSLESS PRIMARY OPTICS SYSTEM, AND PERFECTLY RANDOM LED COLOR MIXING SYSTEM

TECHNICAL FIELD

The present invention is in the field of lamps and lighting fixtures and, more particularly, to an improved light projection system for efficiently redirecting substantially all of the light rays being emitted from a light source along a single projecting axis to form a precisely controllable high intensity beam of light providing maximum efficiency.

BACKGROUND OF THE INVENTION

Lamps and lighting fixtures have long been used to provide basic illumination and for specialty purposes such as, but not limited to, theatrical lighting, entertainment lighting, sports lighting, parking lot lighting, street lighting, and many other uses too numerous to list here. A majority of these lamps and lighting fixtures use devices such as various types of reflectors, various types of lenses, or a combination of these said devices in order to increase the efficiency and therefore increase usable light output of the light source being used.

It is well known that in many instances it is advantageous to provide a strong, focused beam that can be directed to a relatively small area. Spotlights of all types are an excellent illustration of the usefulness of such beams. On the other hand, there are many circumstances in which a divergent beam of light is particularly desirable. For example, a strong divergent beam of light is often used for nighttime exterior illumination purposes.

Many attempts have been made to modify or vary the construction of ordinary light projection systems in an effort to find a more efficient and satisfactory design. Prior light projection systems and illumination devices are subject to several disadvantages and drawbacks, however. One such drawback is the fact that undue complication of the reflector and lens configuration decreases the commercial marketability of the system and degrades efficiency. Another drawback is that, in spite of various lens and reflector arrangements, a light projection system which controls the direction and projection of a large percentage of available light rays, and is capable of combining substantially all of those available light rays with a minimum amount of degradation or loss of efficiency, has only been possible using light sources with a small diameter or point source light generation area.

Spherical, Parabolic, and Ellipsoidal type reflector systems have long been used in the ordinary light projection systems mentioned above. The Cone shaped reflector is one of the oldest and most easily made reflector systems but the system was discarded because no one ever found a way to use this reflector to produce a beam easily controlled, efficient, and able to produce an even beam field. FIG. 20A is a Prior Art example of a traditional cone shaped reflector system using a high output incandescent lamp with a small filament. FIG. 21A is a Prior Art example of an LED package system using a low profile cone shaped reflector section coupled with an encapsulating lens. And FIG. 22A is a Prior Art example of a Cree U.S. Pat. No. 9,084,328 B2 patent color mixing led package with a cone shaped segment and diffraction lens.

It should also be appreciated that, because of the continuing energy crisis, lamps and lighting fixtures with the ability to use high efficiency light sources with a square, rectangular, or unconventional shape with a large diameter or cross sectional dimension, such as LEDs (light emitting diodes), and do so with maximum efficiency, is extremely desirable.

Also, because of the advent of semiconductor or LED light source usage, there is a need to produce an LED die package that can extract a maximum amount of light produced by the die and couple it into the existing environment at an angle that is most advantageous to lighting fixture designers. Until now, the most efficient LED and die package sources have a wide angle of radiation because there is a large amount of loss in efficiency when using conventional means to produce an LED die and package with a spot or narrow field of radiation. It should be appreciated that this hinders the production of smaller more efficient spotlight projection systems used in many industries. LEDs are also available in various colors and this has created additional problems when trying to create color changing LEDs, lamps, lighting fixtures, or video projection systems. There have been many complicated attempts to overcome the problem of having separate color light sources feed into systems using conventionally accepted spherical, parabolic, and ellipsoidal reflector systems. None have been completely successful. It should be appreciated that there is a need for a color mixing system that eliminates all haloing or color shadowing and at the same time virtually eliminates the conventional problems of "Etendue" and "throughput" in projection systems.

Additionally it is desirable for the light projection system to provide a beam field where the light is distributed as evenly as possible in order to be useful in exacting applications such as live theatre productions, video, TV production, film projection industry, and electronic projection industry such as computer, cell phone, and home television and entertainment systems.

Accordingly, there has been a need for an improved projection system with increased efficiency which can combine and control substantially all of the light emanating from a light source. The system must be simple to construct, inexpensive, and sufficiently utilitarian so that a device embodying the system could be manipulated to produce either a spotlight-type beam or a divergent beam. Additionally, the improved projection system should be readily adaptable for use in all types of lamps or as part of a portable illumination device as well as a much larger permanent or semi-permanent lighting installation device. There is also a need in the automotive and aircraft industries to produce a simple, low cost, and efficient light system to project a very even and tightly controlled beam of light. The present invention fulfills all these needs.

SUMMARY OF THE INVENTION

The vortex light projection system is the most versatile system ever discovered and mathematically unlike any other reflector group or type. The spherical, parabolic, and ellipsoidal reflectors are each made by use of one specific mathematical formula and they cannot change the shape of their beam field without the addition of lenses, gates, shutters, or barn doors.

The vortex primary light projection system is produced by the interaction of three variables: the apex focal area, the mouth, and the length of the cone shaped reflector. The mathematical interaction of two of these three variables is restricted to set ranges and the exact number used for these two variables will produce a unique beam field with a set size and a specific angle of radiation of the projected beam field and the shape of said beam field can be changed by using various shapes for the apex and mouth of the cone shaped reflector.

Objects of the invention are to provide a lamp or light projection system with a superior primary optics system for use in combination with a light source in projecting a beam of light at a distant location, while utilizing a substantially greater proportion of visible light emitted by said light source. An alternative embodiment of the fixture projects a substantially lower proportion of infrared light emitted by the lamp and provides more efficient cooling through the use of various heat sinks. Still another embodiment has a light source composed of multiple LEDs of various colors and the superior primary optics system provides perfectly random projection of said various color light rays thereby providing perfectly mixed colors in the common beam field. A substantially more efficient lighting fixture thereby is provided.

This permits a conveniently adjusted lighting fixture having lower power consumption in a more compact form and a system that can be higher in power but not as harmful to lens made of plastic, or the media that it is projecting, or objects that are in the projected beam path.

These and other objects of the present invention are achieved by providing a lamp unit or a light projection system comprising a cone shaped reflector configured about a longitudinal axis wherein said reflector has a focal point cross sectional area near the apex and a larger open end configured to be not less than 1.6 times the dimension of said apex and is the mouth of said reflector located at a distance from said apex of not less than 0.5, and not more than 7, times the diameter of said larger open end, a finite light source with a shape, diameter, and cross sectional dimension substantially equal to the shape and cross sectional dimension of said focal point cross sectional area near the apex of said cone shaped reflector and positioned with the base of said light source at, or near, the apex focal point of the reflector, wherein a substantial portion of the light emitted from the light source is projected and reflected in a vortex to form a controlled beam of light with an even beam field containing a maximum number of light rays generated by said light source thereby increasing usefulness and efficiency.

In an alternate embodiment of the invention, the invention includes a reflector aligned perpendicular to the longitudinal axis of the cone shaped reflector and positioned adjacent the apex focal point cross sectional area of said cone shaped reflector and at or near the base of the light source.

In another alternate embodiment of the invention, the shape of the focal point cross sectional area near the apex and the shape of the said larger open end are selected from the group of shapes consisting of round, elliptical, square, triangular, rectangular, and asymmetrical with the shape of the said cone shaped reflector transitioning smoothly from the shape of the said focal point area near the apex to the shape of the said larger open end.

In still another alternate embodiment of the invention, a lens aligned with the longitudinal axis of the cone shaped reflector is positioned at a point adjacent the larger open end of the said reflector with the focal length of the said lens substantially equal to the distance from the light source to the said lens. This embodiment also includes a gate having an aperture adjacent the large open end of the cone shaped reflector and aligned with the longitudinal axis of the reflector system, and a second lens movable and positioned on the side of the gate opposite the reflector and light source wherein a substantial amount of the light emitted by said light source forms a vortex of light directed and reflected through the lens, the gate, and the second lens, to project a beam of light or image to a distant point.

Still another alternate embodiment of the invention is an LED Lamp comprising: a cone shaped reflector configured about a longitudinal axis wherein the said reflector has a focal point cross sectional area near the apex and a larger open end configured to be the mouth of the said reflector, a substrate having traces, one or more light emitting diodes (LEDs), or diode arrays, serving as the light source connected to the said traces and mounted on the said substrate with a diameter or cross sectional dimension substantially equal to the said reflector cross sectional dimension of the apex focal point area and positioned with the base of the said light source at the said apex focal point, a reflector aligned perpendicular to the longitudinal axis of the cone shaped reflector and positioned adjacent the apex focal point of said cone shaped reflector and at the base of the said LED light source.

Still further advantages of the present invention will become apparent to those of ordinary skill in the art upon reading and understanding the following detailed description of the preferred embodiments.

BRIEF DESCRIPTION OF THE DRAWING

FIG. 1A is a schematic diagram with a side view of a first embodiment of an LED illumination system in accordance with the invention, including a cone shaped reflector with a square apex and a square mouth and an LED light source.

FIG. 1B is a schematic diagram with a front view of a first embodiment of an LED illumination system in accordance with the invention, including a cone shaped reflector with a square apex and a square mouth and an LED light source.

FIG. 1C is a list of definitions and formulas disclosing the restrictions used to design the cone shaped reflectors which are the heart of the invention.

FIG. 1D is a dimensional view of the first embodiment of the invention and a target used to display and measure the beam field produced.

FIG. 1E is a computer generated 3D plot of the beam field produced by the first embodiment of the invention.

FIG. 1F is a computer generated raytrace of the beam field produced by the first embodiment of the invention.

DETAILED DESCRIPTION OF THE INVENTION

Figure 2A:
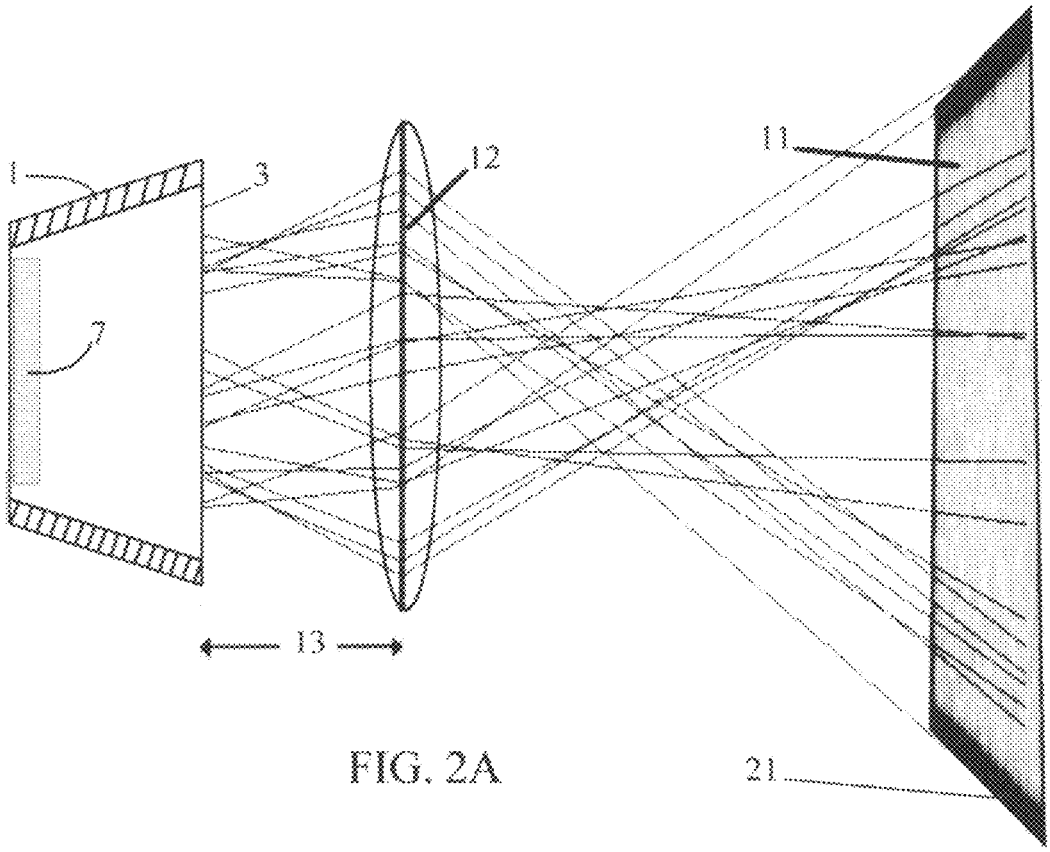
FIG. 2A is a schematic diagram of an alternate embodiment in accordance with the invention, including a cone shaped reflector with a square apex and a square mouth, an LED light source, a lens, and a target to measure and display the beam field.

Reference will now be made in detail to the present preferred embodiment of the invention, examples of which are illustrated by the accompanying drawings. All of the computer generated information and prototyping was produced by the Breault ASAP Ray-Tracing Software program known throughout the optics industry for its accuracy and efficiency, and considered to be the best available. While the invention will be described in connection with a preferred embodiment, it will be understood that it is not intended to limit the invention to that embodiment.

FIG. 1A is a schematic diagram with a side view, and FIG. 1B is a schematic diagram with a front view of a first embodiment of an improved primary optics illumination system in accordance with the invention, including a cone shaped reflector 1 with a square apex 2 and a square mouth 3 and an LED light source 7. The cone shaped reflector 1 is configured about a longitudinal axis wherein said reflector 1 has an apex 2 with a focal point cross sectional area 2 configured to receive or support a light source 7, a larger open end configured to be the mouth 3 of said reflector 1 with a diameter or cross sectional dimension 4 of 1.6 times the diameter or cross sectional dimension 5 of said apex focal point cross sectional area 2, and a length 6, the distance from said apex 2 to said mouth 3, is 0.5 (one half) times the diameter of said mouth dimension 4. The shape and cross sectional dimension 8 of the LED light source 7 is substantially equal to the shape and cross sectional dimension 5 of the apex focal point area 2 of the reflector 1 and is positioned with the base of said light source 7 at, or near, the said apex focal point area 2 configured to receive or support a light source 7. Substantially all of the light emitted from the light source 7 is projected and reflected to form a controlled vortex beam of light producing a smoother, more precisely shaped, and even beam field 11 containing a maximum number of light rays generated by said light source 7 thereby increasing efficiency.

FIG. 1C discloses the important parameters and mathematical formulas used to design the cone shaped reflector 1. A is the cone 1 apex 2 dimension 5, M is the cone 1 mouth 3 dimension 4, and L is the cone 1 length dimension 6. To design your reflector 1, first select the size of your desired apex 2 dimension 5. The mouth 3 dimension 4 is determined by multiplying the apex 2 dimension 5 times a number of 1.6 or more. The length 6 is then determined by multiplying the mouth 3 dimension 4 by a number not less than 0.5 (one half) and not more than 7 (seven).

FIG. 1D shows the reflector 1 incorporated in an LED package projecting light onto a target 21 located just above the mouth of the LED package system. FIG. 1E is a computer generated 3D plot of the projected beam field 11 and shows the system efficiency is 99.98859%. This means the only loss in the system will be from the reflectivity coefficient of the material used in the reflector. FIG. 1F shows the computer generated even beam field 11 projected onto the target 21.

Figure 2B:
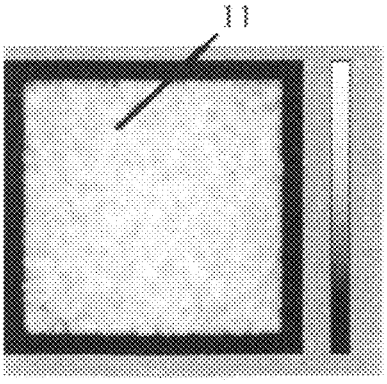
FIG. 2B is a computer generated raytrace of the beam field produced by the alternate embodiment of the invention.
Figure 2C:
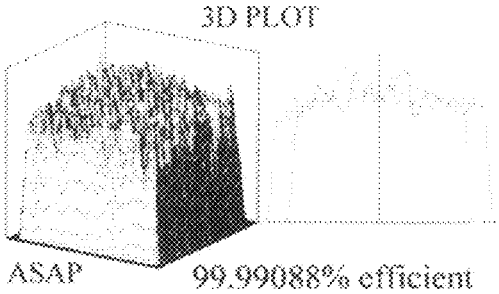
FIG. 2C is a computer generated 3D plot of the beam field produced by the alternate embodiment of the invention.

FIG. 2A is a schematic diagram of an alternate embodiment in accordance with the invention, including a cone shaped reflector 1 and LED light source 7 as shown in FIG. 1A and FIG. 1B, a lens 12, and a target 21 to measure and display the beam field 11. The focal length 13 of the lens 12 is the distance from the lens 12 to the mouth 3. FIG. 2B is a computer generated raytrace of the beam field 11 produced by the alternate embodiment of the invention. FIG. 2C is a computer generated 3D plot of the beam field produced by the alternate embodiment of the invention and shows the system is 99.99088% efficient. This means the only loss in the system will be the reflectivity coefficient of the material used in the reflector 1 and the lens 12 transmission coefficient.

Figure 3A:
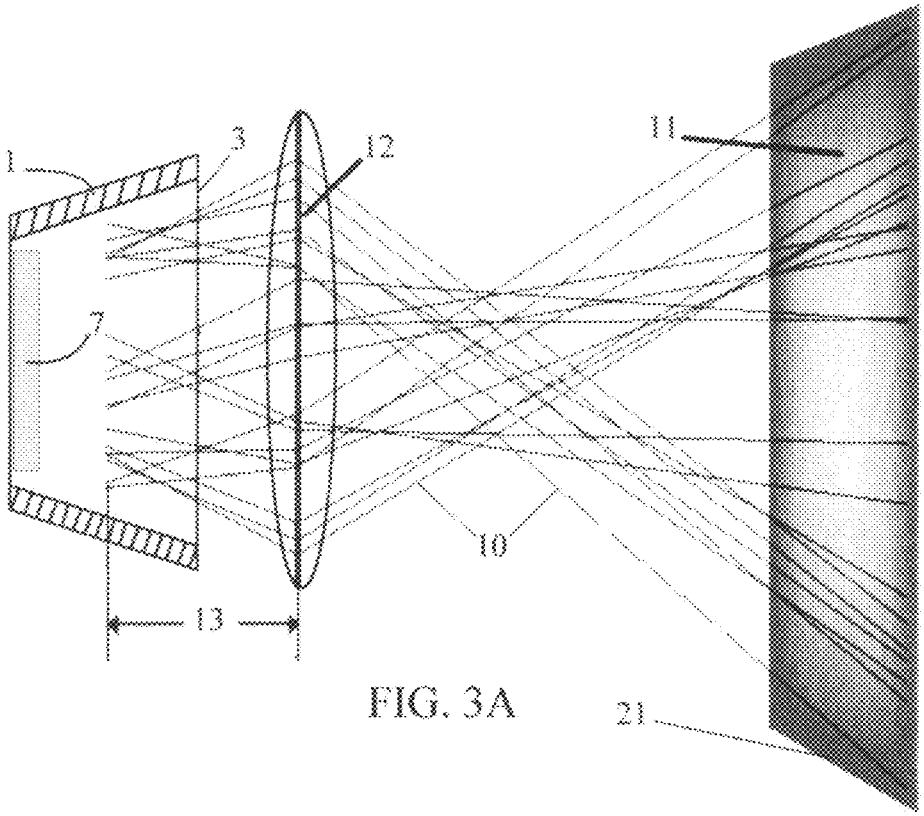
FIG. 3A is a schematic diagram of another alternate embodiment in accordance with the invention, including a cone shaped reflector with a square apex and a square mouth, an LED light source, a lens, and a target to measure and display the beam field.
Figure 3B:
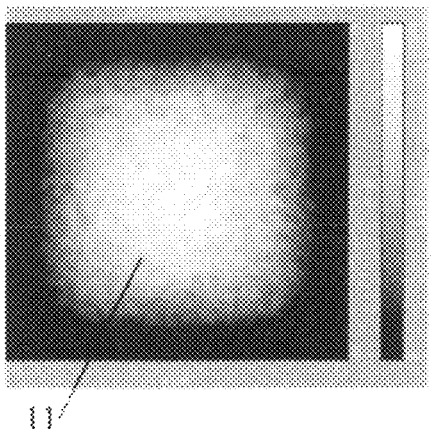
FIG. 3B is a computer generated raytrace of the beam field produced by the alternate embodiment of the invention.
Figure 3C:
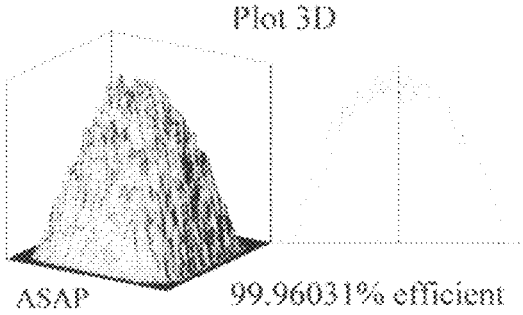
FIG. 3C is a computer generated 3D plot of the beam field produced by the alternate embodiment of the invention.

FIG. 3A is a schematic diagram of an alternate embodiment in accordance with the invention, including a cone shaped reflector 1 and LED light source 7 as shown in FIG. 1A and FIG. 1B, a lens 12, and a target 21 to measure and display the beam field 11. The focal length 13 of the lens 12 is the distance from the lens 12 to a point half way between the apex 2, to the mouth 3. FIG. 3B is a computer generated raytrace of the beam field 11 produced by the alternate embodiment of the invention. FIG. 3C is a computer generated 3D plot of the beam field produced by the alternate embodiment of the invention and shows the system is 99.96031% efficient. This means the only loss in the system will be the reflectivity coefficient of the material used in the reflector 1 and the lens 12 transmission coefficient.

Figure 4A:
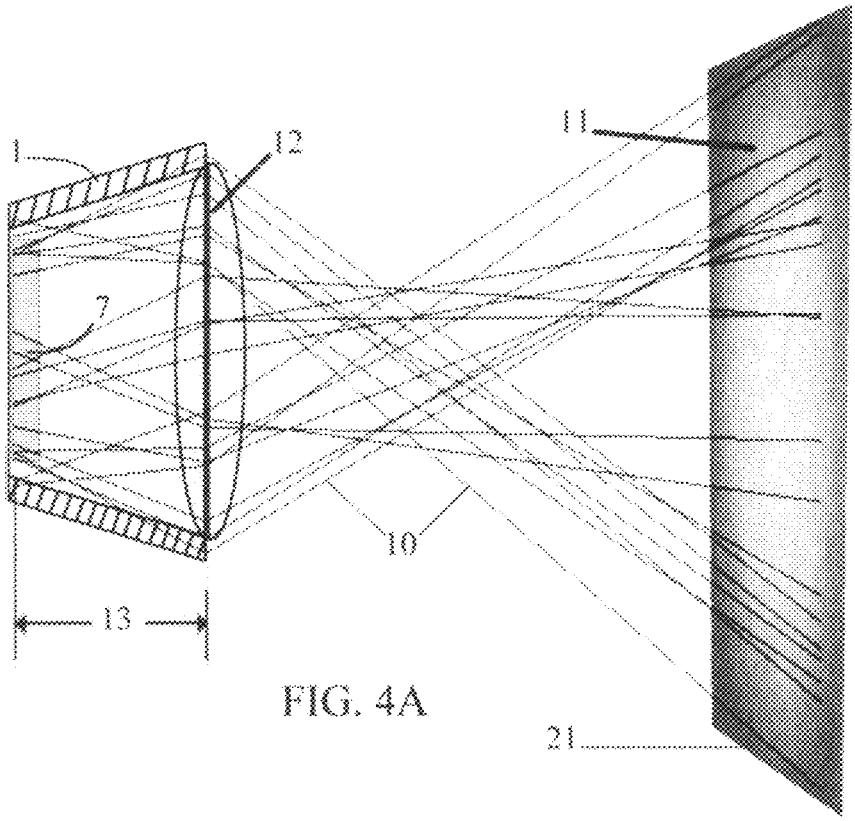
FIG. 4A is a schematic diagram of another alternate embodiment in accordance with the invention, including a cone shaped reflector with a square apex and a square mouth, an LED light source, a lens, and a target to measure and display the beam field.
Figure 4B:
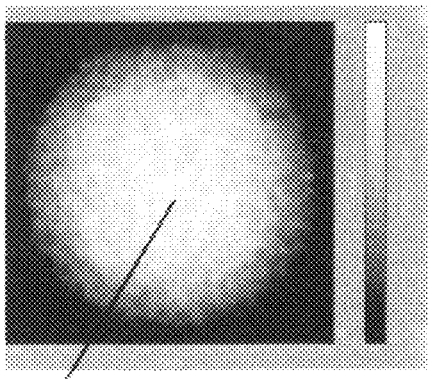
FIG. 4B is a computer generated raytrace of the beam field produced by the alternate embodiment of the invention.
Figure 4C:
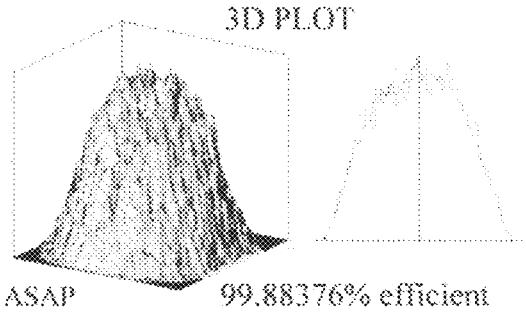
FIG. 4C is a computer generated 3D plot of the beam field produced by the alternate embodiment of the invention.

FIG. 4A is a schematic diagram of an alternate embodiment in accordance with the invention, including a cone shaped reflector 1 and LED light source 7 as shown in FIG. 1A and FIG. 1B, a lens 12, and a target 21 to measure and display the beam field 11. The focal length 13 of the lens 12 is the distance from the lens 12 to the apex 2. FIG. 4B is a computer generated raytrace of the beam field 11 produced by the alternate embodiment of the invention. FIG. 4C is a computer generated 3D plot of the beam field produced by the alternate embodiment of the invention and shows the system is 99.88376% efficient. This means the only loss in the system will be the reflectivity coefficient of the material used in the reflector 1 and the lens 12 transmission coefficient.

Figure 5A:
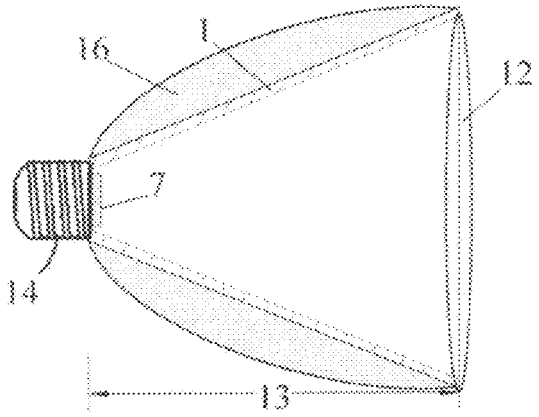
FIG. 5A is a schematic diagram side view of an alternate embodiment in accordance with the invention, including a cone shaped reflector with a round apex and a round mouth, an LED light source, a lens, and a medium base socket including electronics to adapt the lamp to standard line voltage.
Figure 5B:
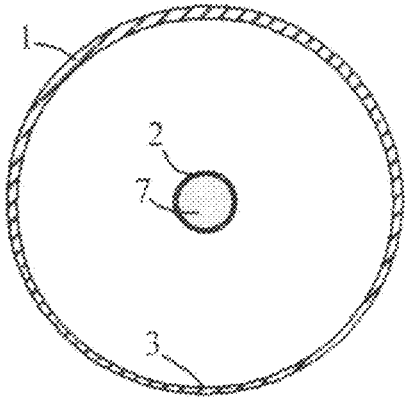
FIG. 5B is a schematic diagram front view of an alternate embodiment in accordance with the invention, including a cone shaped reflector with a round apex and a round mouth, an LED light source, a lens, and a medium base socket including electronics to adapt the lamp to standard line voltage.
Figure 5C:
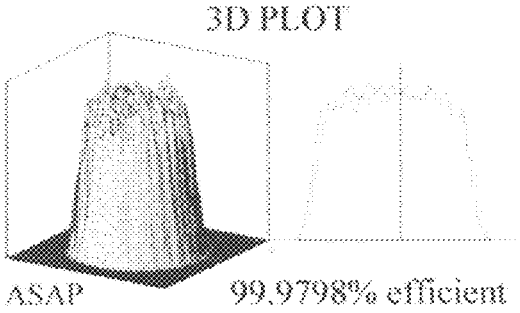
FIG. 5C is a computer generated 3D plot of the beam field produced by the alternate embodiment of the invention including a lens with no magnification.
Figure 5D:
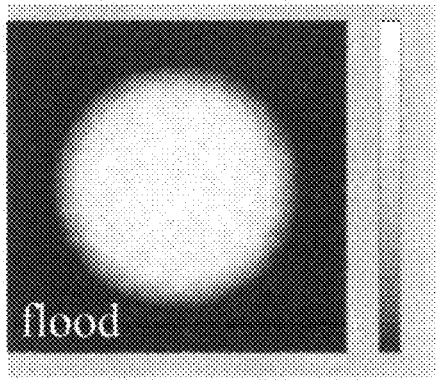
FIG. 5D is a computer generated raytrace of the beam field produced by the alternate embodiment of the invention including a lens with no magnification.
Figure 5E:
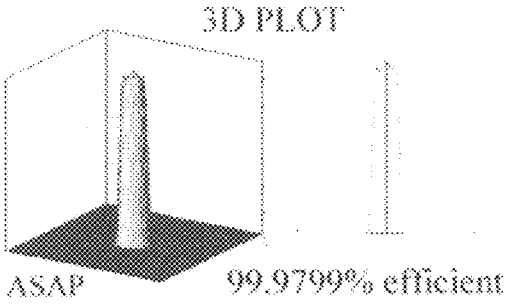
FIG. 5E is a computer generated 3D plot of the beam field produced by the alternate embodiment of the invention including a lens with a focal length from the lens to the LED light source.
Figure 5F:
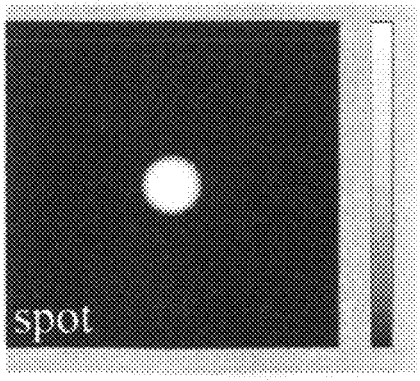
FIG. 5F is a computer generated raytrace of the beam field produced by the alternate embodiment of the invention including a lens with a focal length from the lens to the LED light source.

FIG. 5A is a schematic diagram side view, and FIG. 5B is a schematic diagram front view of an alternate embodiment in accordance with the invention, including a cone shaped reflector 1 with intergrated heat sink 16 and with a round apex 2 and a round mouth 3, an LED light source 7, a lens 12, and a medium base socket 14 including electronics to adapt the lamp to standard line voltage. FIG. 5C is a computer generated 3D plot of the beam field produced by the alternate embodiment of the invention wherein the lens 12 has no magnification, and shows the system is 99.9798% efficient. FIG. 5D is a computer generated raytrace of the beam field produced by the alternate embodiment of the invention wherein the lens 12 has no magnification. FIG. 5E is a computer generated 3D plot of the beam field produced by the alternate embodiment of the invention including a lens 12 with a focal length 13 from the lens 12 to the LED light source 7 and shows the system is 99.9799% efficient. FIG. 5F is a computer generated raytrace of the beam field produced by the alternate embodiment of the invention including a lens with a focal length 13 from the lens 12 to the LED light source 7. This means the only loss in the system will be the reflectivity coefficient of the material used in the reflector and the lens transmission coefficient.

Figure 6A:
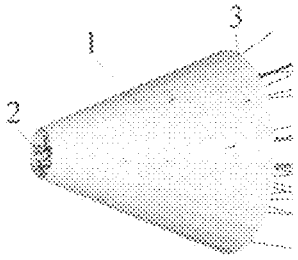
FIG. 6A is a dimensional view of an alternate embodiment of the invention including a reflector with a round apex and a round mouth, and a light source positioned at the apex.
Figure 6B:
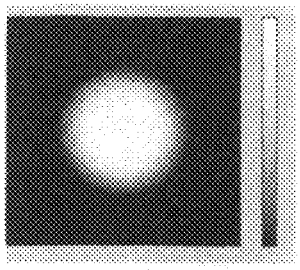
FIG. 6B is a computer generated raytrace of the beam field produced by the alternate embodiment of the invention.
Figure 6C:
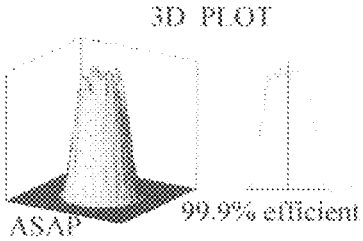
FIG. 6C is a computer generated 3D plot of the beam field produced by the alternate embodiment of the invention.

FIG. 6A is a dimensional view of an alternate embodiment of the invention including a reflector 1 with a round apex 2 and a round mouth 3, and a light source 7 positioned at the apex 2. FIG. 6B is a computer generated raytrace of the beam field 11 produced by the alternate embodiment of the invention. FIG. 6C is a computer generated 3D plot of the beam field 11 produced by the alternate embodiment of the invention.

Figure 7A:
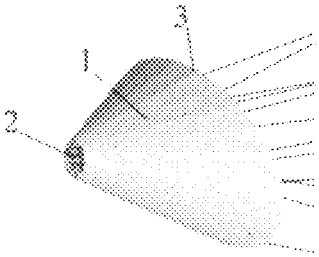
FIG. 7A is a dimensional view of an alternate embodiment of the invention including a reflector with a round apex and an elliptical mouth, and a light source positioned at the apex.
Figure 7B:
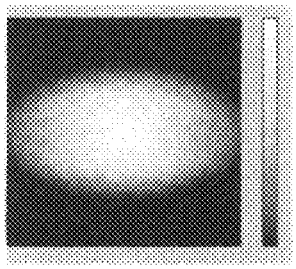
FIG. 7B is a computer generated raytrace of the beam field produced by the alternate embodiment of the invention.
Figure 7C:
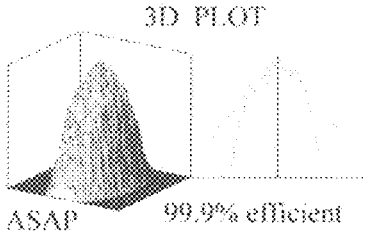
FIG. 7C is a computer generated 3D plot of the beam field produced by the alternate embodiment of the invention.

FIG. 7A is a dimensional view of an alternate embodiment of the invention including a reflector 1 with a round apex 2 and an elliptical mouth 3, and a light source 7 positioned at the apex 2. FIG. 7B is a computer generated raytrace of the beam field 11 produced by the alternate embodiment of the invention. FIG. 7C is a computer generated 3D plot of the beam field 11 produced by the alternate embodiment of the invention.

Figure 8A:
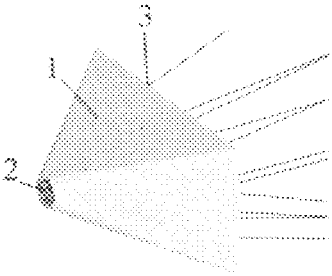
FIG. 8A is a dimensional view of an alternate embodiment of the invention including a reflector with a round apex and a rectangular mouth, and a light source positioned at the apex.
Figure 8B:
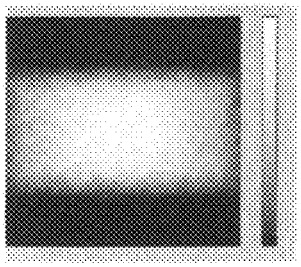
FIG. 8B is a computer generated raytrace of the beam field produced by the alternate embodiment of the invention.
Figure 8C:
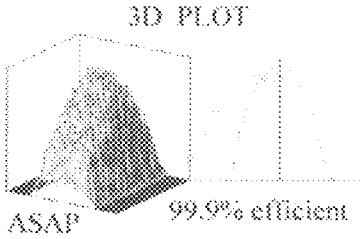
FIG. 8C is a computer generated 3D plot of the beam field produced by the alternate embodiment of the invention.

FIG. 8A is a dimensional view of an alternate embodiment of the invention including a reflector 1 with a round apex 2 and a rectangular mouth 3, and a light source 7 positioned at the apex 2. FIG. 8B is a computer generated raytrace of the beam field 11 produced by the alternate embodiment of the invention. FIG. 8C is a computer generated 3D plot of the beam field 11 produced by the alternate embodiment of the invention.

Figure 9A:
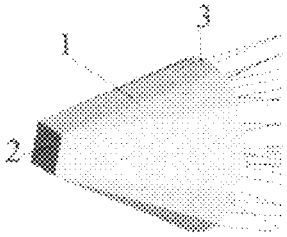
FIG. 9A is a dimensional view of an alternate embodiment of the invention including a reflector with a square apex and a round mouth, and a light source positioned at the apex.
Figure 9B:
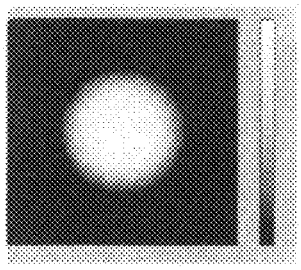
FIG. 9B is a computer generated raytrace of the beam field produced by the alternate embodiment of the invention.
Figure 9C:
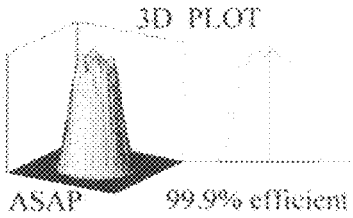
FIG. 9C is a computer generated 3D plot of the beam field produced by the alternate embodiment of the invention.

FIG. 9A is a dimensional view of an alternate embodiment of the invention including a reflector 1 with a square apex 2 and a round mouth 3, and a light source 7 positioned at the apex 2. FIG. 9B is a computer generated raytrace of the beam field 11 produced by the alternate embodiment of the invention. FIG. 9C is a computer generated 3D plot of the beam field 11 produced by the alternate embodiment of the invention.

Figure 10A:
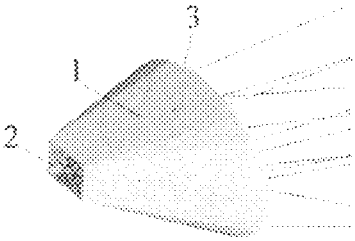
FIG. 10A is a dimensional view of an alternate embodiment of the invention including a reflector with a rectangular apex and an elliptical mouth, and a light source positioned at the apex.
Figure 10B:
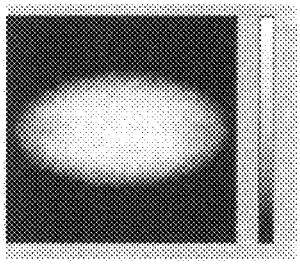
FIG. 10B is a computer generated raytrace of the beam field produced by the alternate embodiment of the invention.
Figure 10C:
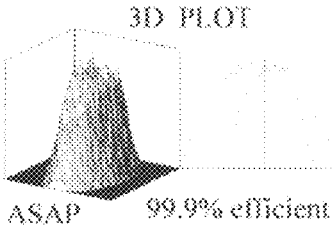
FIG. 10C is a computer generated 3D plot of the beam field produced by the alternate embodiment of the invention.

FIG. 10A is a dimensional view of an alternate embodiment of the invention including a reflector 1 with a rectangular apex 2 and an elliptical mouth 3, and a light source 7 positioned at the apex 2. FIG. 10B is a computer generated raytrace of the beam field 11 produced by the alternate embodiment of the invention. FIG. 10C is a computer generated 3D plot of the beam field 11 produced by the alternate embodiment of the invention.

Figure 11A:
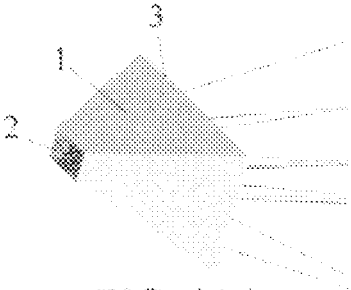
FIG. 11A is a dimensional view of an alternate embodiment of the invention including a reflector with a rectangular apex and a rectangular mouth, and a light source positioned at the apex.
Figure 11B:
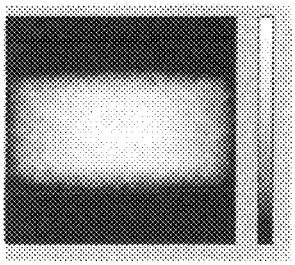
FIG. 11B is a computer generated raytrace of the beam field produced by the alternate embodiment of the invention.
Figure 11C:
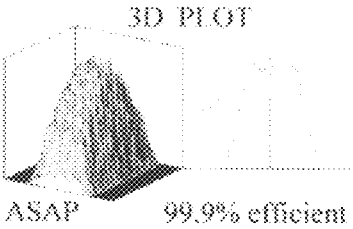
FIG. 11C is a computer generated 3D plot of the beam field produced by the alternate embodiment of the invention.

FIG. 11A is a dimensional view of an alternate embodiment of the invention including a reflector 1 with a rectangular apex 2 and a rectangular mouth 3, and a light source 7 positioned at the apex 2. FIG. 11B is a computer generated raytrace of the beam field 11 produced by the alternate embodiment of the invention. FIG. 11C is a computer generated 3D plot of the beam field 11 produced by the alternate embodiment of the invention.

The last six alternate embodiments of the invention show that the shape of the mouth 3 determines the shape of the beam field 11. All of the last six embodiments show the illumination systems are at least 99.9% efficient therefore the only loss in the system will be the reflectivity coefficient of the material used in the reflector.

Figure 12E:
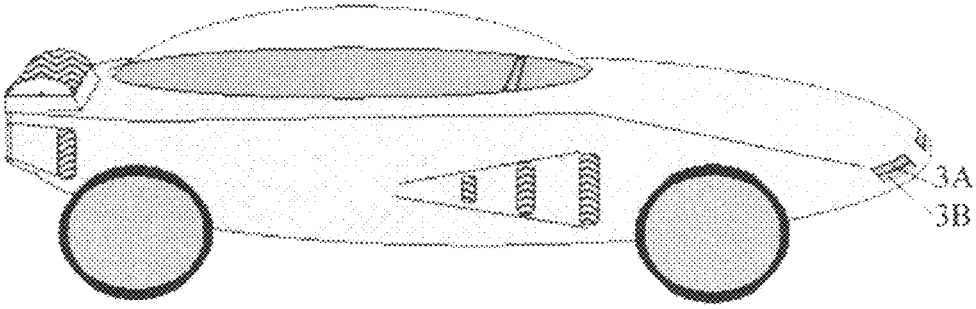
FIG. 12E is a dimensional view of an automobile including an alternate embodiment of the invention including a segmented reflector.
Figure 12A:
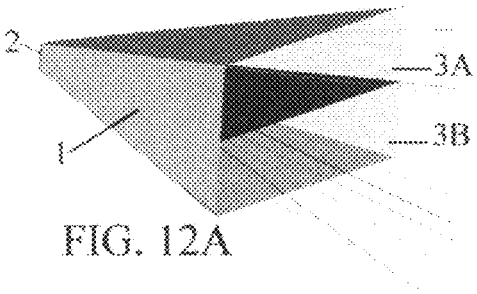
FIG. 12A is a dimensional view of an alternate embodiment of the invention including a segmented reflector with a rectangular apex and a rectangular mouth with 2 segments 3A and 3B, and a light source positioned at the apex each segment.
Figure 12B:
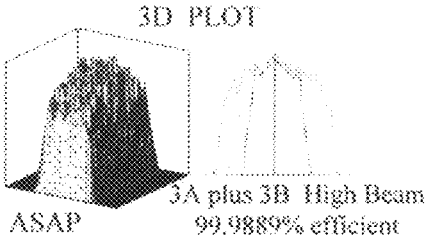
FIG. 12B is a computer generated 3D plot of the beam field produced by the alternate embodiment of the invention including segments 3A and segments 3B of the segmented reflector.
Figure 12C:
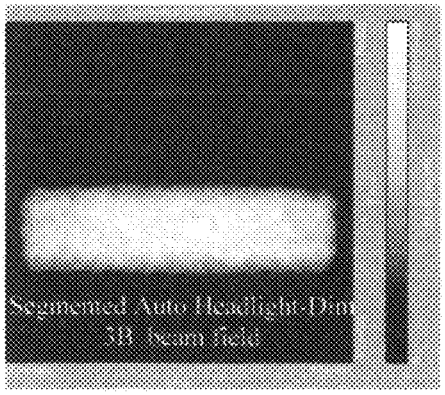
FIG. 12C is a computer generated raytrace of the beam field produced by the alternate embodiment of the invention including segment 3A and light source of the segmented reflector producing a "dim beam" auto beam field.
Figure 12D:
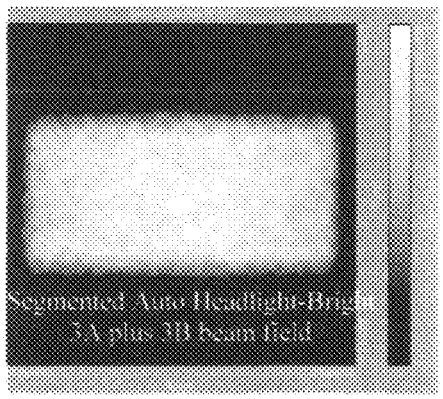
FIG. 12D is a computer generated raytrace of the beam field produced by the alternate embodiment of the invention including segment 3A with light source and segment 3B with light source producing a "high beam" auto beam field.

FIG. 12A is a dimensional view of an alternate embodiment of the invention including a segmented reflector 1 with a rectangular apex 2, a rectangular mouth with two segments 3A and 3B, and a light source positioned at the apex 2 of each segment 3A and 3B. FIG. 12B is a computer generated 3D plot of the beam field 11 produced by the alternate embodiment of the invention including the segmented reflector 1 with segment 3A with light source and segment 3B with light source. FIG. 12C is a computer generated raytrace of the beam field produced by the alternate embodiment of the invention including only segment 3A of the segmented reflector 1 producing a "dim beam" auto beam field. FIG. 12D is a computer generated raytrace of the beam field 11 produced by the alternate embodiment of the invention including segment 3A with light source and segment 3B with light source producing a "high beam" auto beam field. FIG. 12E is a dimensional view of an automobile including the alternate embodiment of the invention including a segmented reflector 1 and showing the mouth segments 3A and 3B. This shows a more accurate and therefore safer auto headlight system can be produced without the added cost of complicated lens systems currently in use.

Figure 13A:
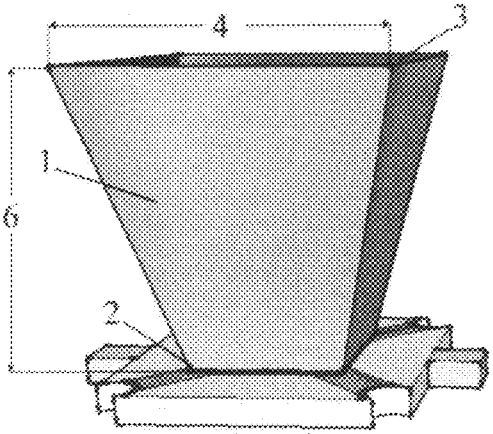
FIG. 13A is a dimensional side view of an alternate embodiment in accordance with the invention, including a cone shaped reflector with a square apex and a square mouth, and a Red, Green, Blue, and Amber LED light source.
Figure 13B:
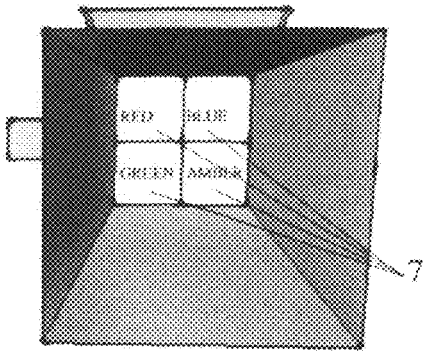
FIG. 13B is a dimensional front view of an alternate embodiment in accordance with the invention, including a cone shaped reflector with a square apex and a square mouth, and a Red, Green, Blue, and Amber LED light source.
Figure 13C:
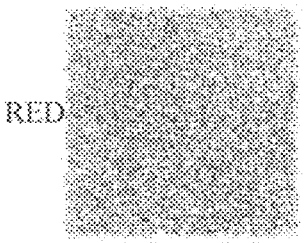
FIG. 13C is a computer generated dot matrix graph of the beam field produced by the Red LED of the alternate embodiment in accordance with the invention.
Figure 13D:
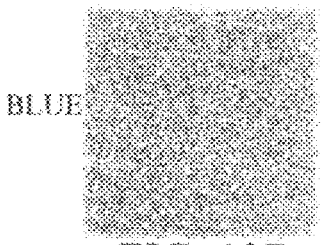
FIG. 13D is a computer generated dot matrix graph of the beam field produced by the Blue LED of the alternate embodiment in accordance with the invention.
Figure 13E:
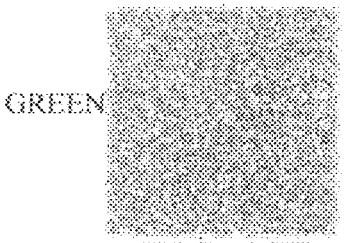
FIG. 13E is a computer generated dot matrix graph of the beam field produced by the Green LED of the alternate embodiment in accordance with the invention.
Figure 13F:
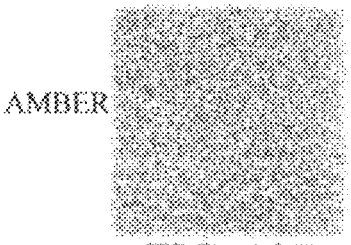
FIG. 13F is a computer generated dot matrix graph of the beam field produced by the Amber LED of the alternate embodiment in accordance with the invention.
Figure 13G:
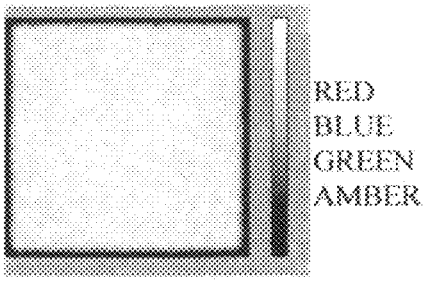
FIG. 13G is a computer generated raytrace of the beam field produced by the alternate embodiment of the invention including and combining the raytraces of the Red, Green, Blue, and Amber LED light source.
Figure 13H:
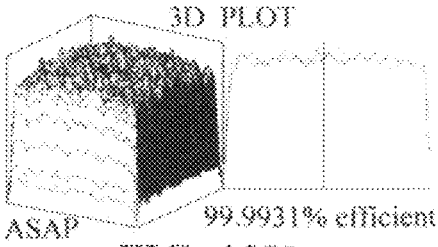
FIG. 13H is a computer generated 3D plot of the beam field produced by the alternate embodiment of the invention including and combining the raytraces of the Red, Green, Blue, and Amber LED light source.

FIG. 13A is a dimensional side view, and FIG. 13B is a dimensional front view of a color mixing LED alternate embodiment in accordance with the invention, including a cone shaped reflector 1 with a square apex 2 and a square mouth 3, and a Red, Green, Blue, and Amber LED light source 7 wherein the length 6 from the mouth 3 to the apex 2 is equal to the dimension 4 of the mouth 3. FIG. 13C is a computer generated dot matrix graph of the beam field 11 produced by the Red LED of the alternate embodiment in accordance with the invention. FIG. 13D is a computer generated dot matrix graph of the beam field 11 produced by the Blue LED of the alternate embodiment in accordance with the invention. FIG. 13E is a computer generated dot matrix graph of the beam field 11 produced by the Green LED of the alternate embodiment in accordance with the invention. FIG. 13F is a computer generated dot matrix graph of the beam field 11 produced by the Amber LED of the alternate embodiment in accordance with the invention. FIG. 13G is a computer generated raytrace of the beam field 11 produced by the alternate embodiment of the invention including and combining the raytraces of the Red, Green, Blue, and Amber LED light source. FIG. 13H is a computer generated 3D plot of the beam field 11 produced by the alternate embodiment of the invention including and combining the raytraces of the Red, Green, Blue, and Amber LED light source. These graphs and raytraces show that the LEDs produce random beam fields with no imagining and no shadowing thereby producing the perfect color mixing system even when large numbers of color LEDs are required.

Figure 14A:
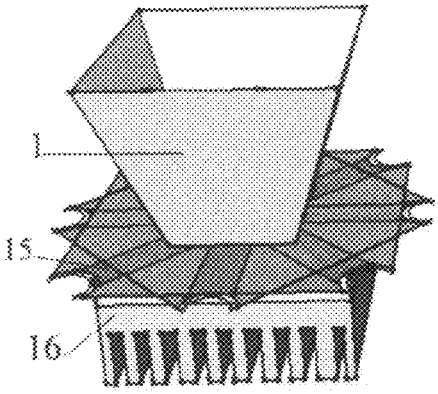
FIG. 14A is a dimensional view of an alternate embodiment of the invention including the reflector, substrate, and heat sink.
Figure 14C:
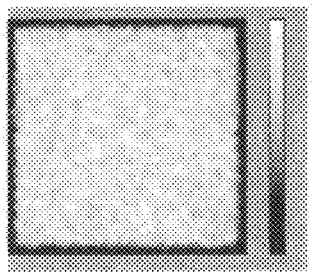
FIG. 14C is a computer generated raytrace of the beam field produced at the mouth of the alternate embodiment of the invention.
Figure 14B:
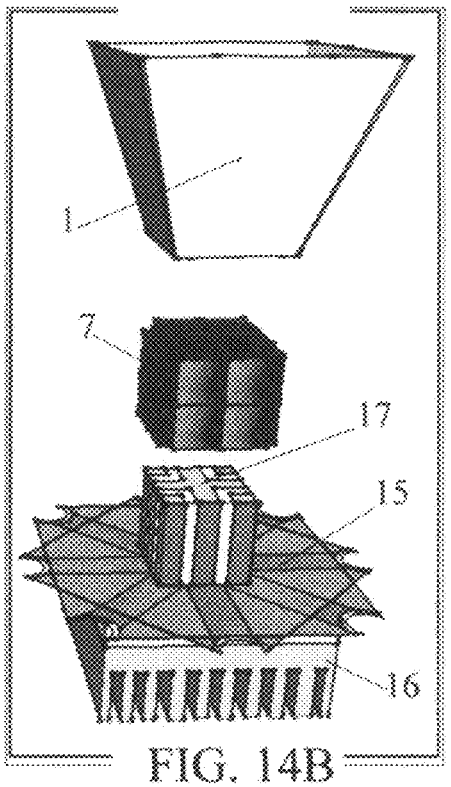
FIG. 14B is an exploded view of the alternate embodiment of the invention showing the reflector, LEDs, mounting post, substrate, and heat sink.

FIG. 14A is a dimensional view of an alternate embodiment of the invention including the reflector 1, substrate 15, and heat sink 16. FIG. 14B is an exploded view of the alternate embodiment of the invention showing the reflector 1, LEDs 7, mounting post 17, substrate 15, and heat sink 16. FIG. 14C is a computer generated raytrace of the beam field 11 projected at the mouth 3 of the alternate embodiment of the invention.

Figure 15A:
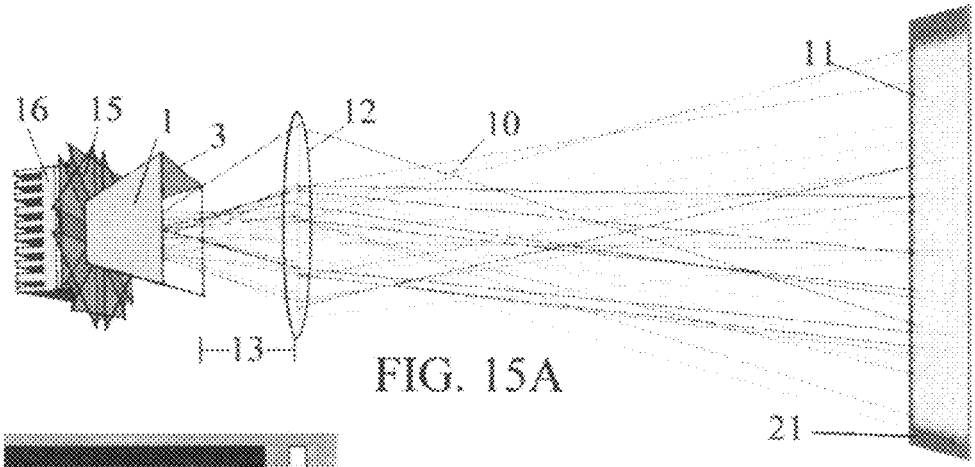
FIG. 15A is a dimensional view of an alternate embodiment of the invention, including a heat sink, a substrate, a cone shaped reflector with a square apex and a square mouth, an LED light source, a lens, and a target to measure and display the beam field.
Figure 15B:
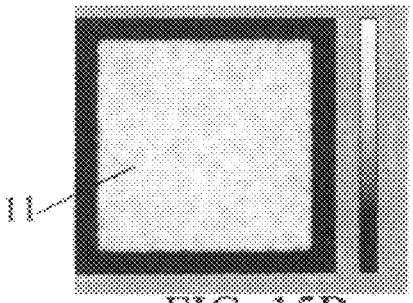
FIG. 15B is a computer generated raytrace of the beam field produced by the alternate embodiment of the invention.
Figure 15C:
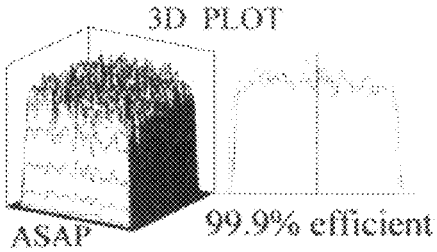
FIG. 15C is a computer generated 3D plot of the beam field produced by the alternate embodiment of the invention.

FIG. 15A is a dimensional view of an alternate embodiment of the invention, including a heat sink 16, a substrate 15, a cone shaped reflector 1 with a square apex 2 and a square mouth 3, an LED light source 7, a lens 12 with a focal length 13 equal to the distance from the lens 12 to the mouth 2 of the reflector 1, and a target 21 to measure and display the beam field 11. FIG. 15B is a computer generated raytrace of the beam field 11 produced by the alternate embodiment of the invention and displayed on the target 21. FIG. 15C is a computer generated 3D plot of the beam field produced by the alternate embodiment of the invention showing a minimum system efficiency of 99.9% therefore the only loss in the system will be the reflectivity coefficient of the material used in the reflector and the lens transmission coefficient.

Figure 16A:
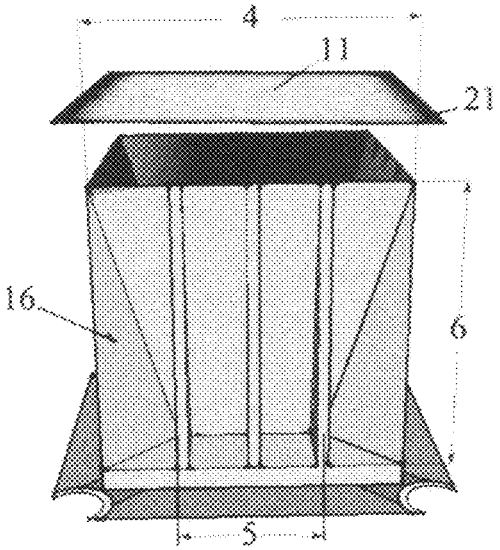
FIG. 16A is a dimensional view of an alternate embodiment of the invention including a reflector with integrated heat sink, substrate, LED light source, and a target used to display and measure the beam field produced.
Figure 16B:
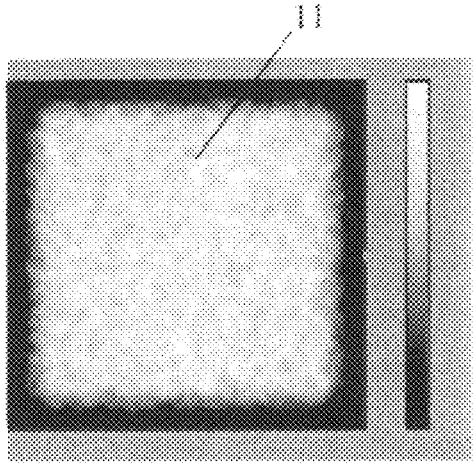
FIG. 16B is a computer generated raytrace of the beam field produced by the alternate embodiment of the invention.

FIG. 16A is a dimensional view of an alternate embodiment of the invention including a reflector 1 with a length 6 equal to the diameter 4 of the mouth 3 and with integrated heat sink 16, a substrate 15, an LED light source 7, and a target 11 used to display and measure the beam field 11 produced. FIG. 16B is a computer generated raytrace of the beam field 11 produced by the alternate embodiment of the invention and displayed on the target 21.

Figure 17:
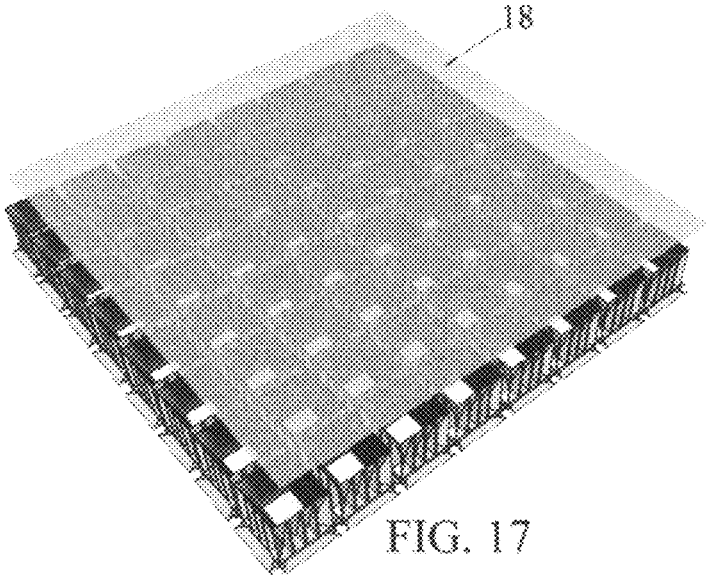
FIG. 17 is a dimensional view of 64 alternate embodiments of the invention joined together to project a high output beam field onto an LCD screen.

FIG. 17 is a dimensional view of 64 alternate embodiments of the invention as shown in FIG. 16A and joined together to project a high output beam field onto an LCD screen 18. This will increase the output and efficiency of many types of image projection systems such as, but not limited to, video, TV, cell phone, and computer screens.

Figure 18:
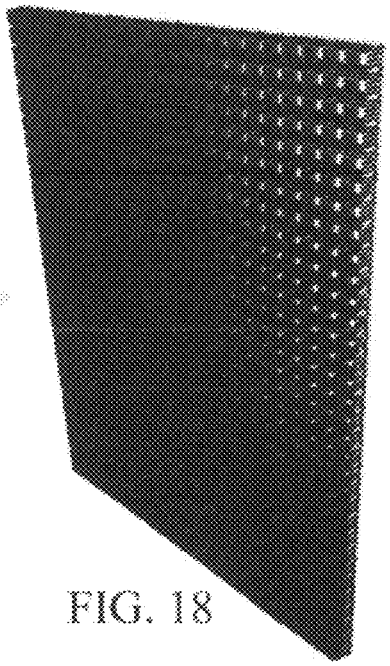
FIG. 18 is a dimensional view of multiple alternate embodiments of the invention joined together to form a high output projection screen.

FIG. 18 is a dimensional view of multiple alternate embodiments of the invention joined together to form a high output projection screen. These systems can be used for high output projection screens, outdoor signs and high resolution theatrical and commercial usage.

Figure 19A:
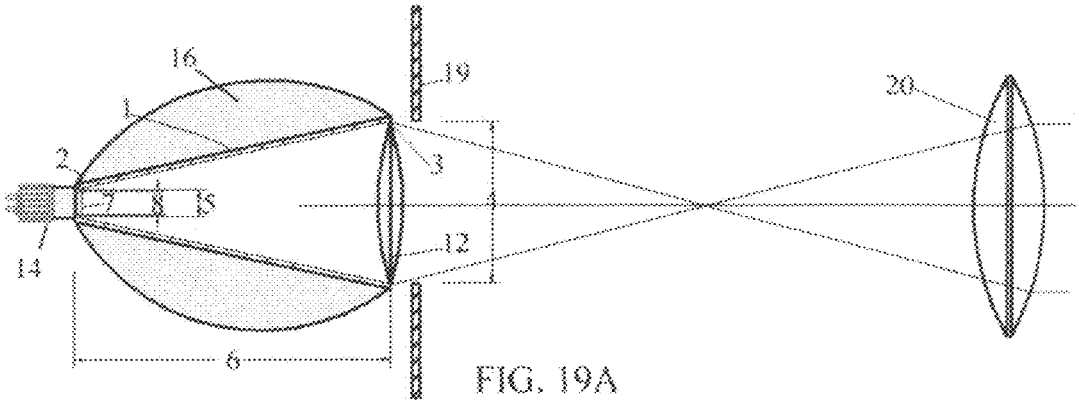
FIG. 19A is a schematic diagram with a side view of an alternate embodiment of an illumination system in accordance with the invention including a second lens, a gate, and including a lamp comprising; a socket, electronics to convert line voltage to power the LEDs, a cone shaped reflector with integral heat sink, an LED light source, and a lens.
Figure 19B:
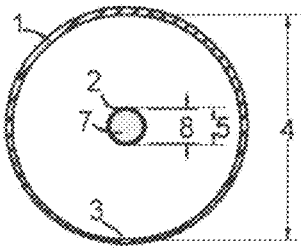
FIG. 19B is a schematic diagram with a front view of an alternate embodiment of the illumination system in accordance with the invention, including a cone shaped reflector with a round apex and a round mouth and a round COB LED light source.
Figure 19C:
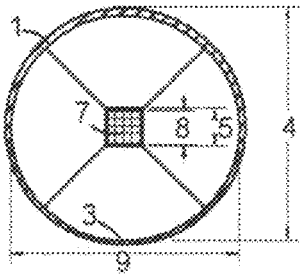
FIG. 19C is a schematic diagram with a front view of an alternate embodiment of the illumination system in accordance with the invention, including a cone shaped reflector with a square apex, a round mouth, and a square array of LED light sources.
Figure 19D:
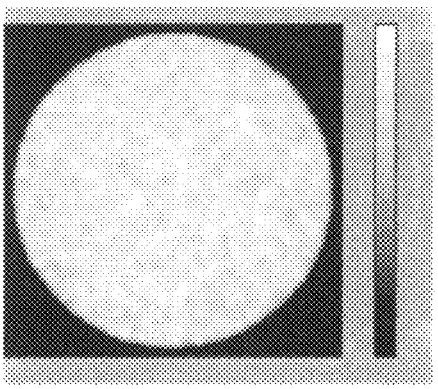
FIG. 19D is a computer generated raytrace of the beam field produced at the gate by the alternate embodiment of the invention.
Figure 19E:
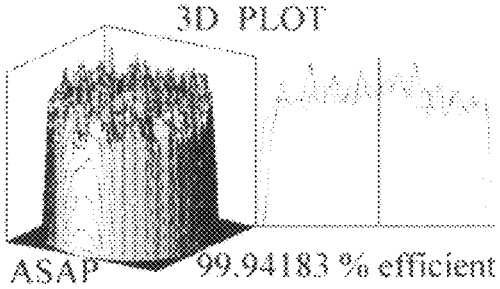
FIG. 19*e* is a computer generated 3D plot of the beam field produced at the gate by the alternate embodiment of the invention.

FIG. 19A is a schematic diagram with a side view of an alternate embodiment of an illumination system in accordance with the invention including a second lens 20, a gate 19, and including a lamp comprising; a socket 14, electronics to convert line voltage to power the LEDs 7, a cone shaped reflector 1 with integral heat sink 16, an LED light source 7, and a lens 12. FIG. 19B is a schematic diagram with a front view of an alternate embodiment of the illumination system in accordance with the invention, including a cone shaped reflector 1 with a round apex 2 and a round mouth 3 and a COB LED light source 7. FIG. 19C is a schematic diagram with a front view of an alternate embodiment of the illumination system in accordance with the invention, including a cone shaped reflector 1 with a square apex 2, a round mouth 3, and an LED array light source 7. FIG. 19D is a computer generated raytrace of the beam field 11 produced at the gate by the alternate embodiment of the invention. FIG. 19E is a computer generated 3D plot of the beam field produced at the gate by the alternate embodiment of the invention showing a system design efficiency of 99.94183%, therefore the only loss in the system will be the reflectivity coefficient of the material used in the reflector and the lens transmission coefficient. This makes it possible to produce high output replacement lamps for use with a multitude of theatrical and video production lighting fixtures.

Figure 20A:
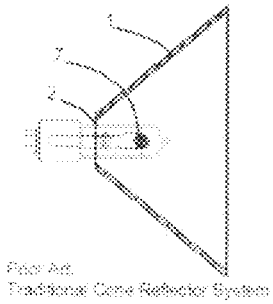
FIG. 20A is a side view of a Prior Art traditional cone shaped reflector system using an incandescent source.
Figure 20B:
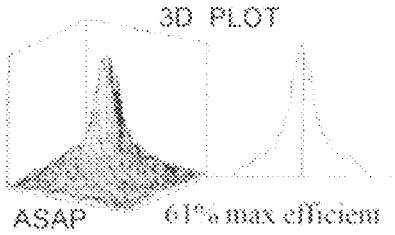
FIG. 20B is a computer generated 3D plot of the beam field produced by the Prior Art traditional cone shaped reflector system using an incandescent source.
Figure 20C:
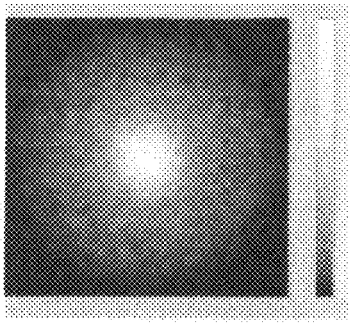
FIG. 20C is a computer generated raytrace of the beam field produced by the Prior Art traditional cone shaped reflector system using an incandescent source.

FIG. 20A is a side view of a Prior Art traditional cone shaped reflector 1 system using an incandescent source 7. FIG. 20B is a computer generated 3D plot of the beam field 11 produced by the Prior Art traditional cone shaped reflector 1 system using an incandescent source 7. FIG. 20C is a computer generated raytrace of the beam field produced by the Prior Art traditional system.

Figure 21A:
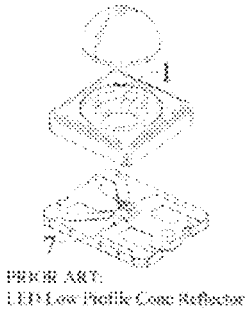
FIG. 21A is a side view of a Prior Art low profile reflector LED cone shaped reflector system.
Figure 21B:
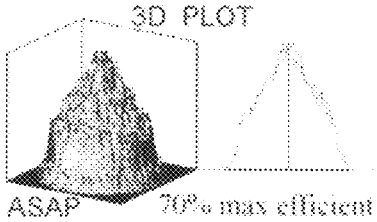
FIG. 21B is a computer generated 3D plot of the beam field produced by the Prior Art low profile reflector LED cone shaped reflector system.
Figure 21C:
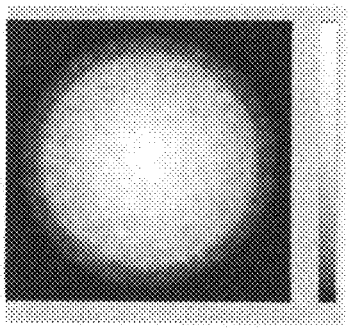
FIG. 21C is a computer generated raytrace of the beam field produced by the Prior Art low profile reflector LED cone shaped reflector system.

FIG. 21A is a side view of a Prior Art low profile reflector 1 LED cone shaped reflector 1 system. FIG. 21B is a computer generated 3D plot of the beam field 11 produced by the Prior Art low profile reflector 1 LED system. FIG. 21C is a computer generated raytrace of the beam field 11 produced by the Prior Art low profile system.

Figure 22A:
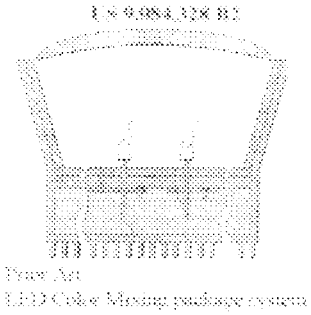
FIG. 22A is a side view of a Prior Art LED color mixing package system.
Figure 22B:
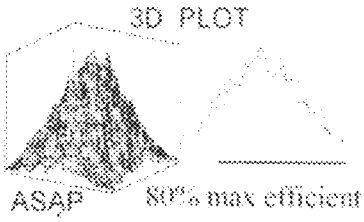
FIG. 22B is a computer generated 3D plot of the beam field produced by the Prior Art LED color mixing package system.
Figure 22C:
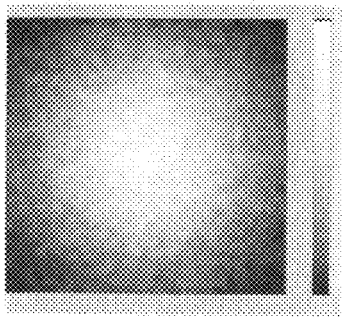
FIG. 22C is a computer generated raytrace of the beam field produced by the Prior Art LED color mixing package system.

FIG. 22A is a side view of a Prior Art LED color mixing package system. FIG. 22B is a computer generated 3D plot of the beam field 11 produced by the Prior Art LED color mixing package system. FIG. 22C is a computer generated raytrace of the beam field produced by the Prior Art LED color mixing package system.

What is claimed is:

1. A light projection system with improved primary optics comprising:

a cone shaped reflector configured about a longitudinal axis wherein said reflector has:

an apex with a focal point cross sectional area having a diameter or cross-sectional dimension configured to receive or support a light source;

a larger open end configured to be a mouth of said reflector with a diameter or cross sectional dimension of not less than 1.6 times the diameter or cross sectional dimension of said apex focal point cross sectional area;

a finite light source comprising a base positioned at, or near, the said apex focal point cross sectional area;

wherein said apex is disposed at a distance from said mouth that is not less than 0.5 times and not more than 7 times the diameter of said mouth and a substantial portion of the light emitted from the finite light source is projected and reflected to form a controlled vortex beam of light producing a smoother more precisely shaped and even beam field containing a maximum number of light rays generated by said light source thereby increasing efficiency.

2. The light projection system of claim 1, wherein a shape and cross sectional dimension of the finite light source is substantially equal to the diameter or cross sectional dimension of the apex focal point area of the reflector.

3. The light projection system of claim 2, including a first lens defining a focal length, wherein the lens is aligned with the longitudinal axis of the reflector and positioned at or beyond a point adjacent the larger open end of said reflector.

4. The light projection system of claim 3, wherein the focal length of the lens is substantially equal to the distance from the larger open end of the reflector system to said lens positioned beyond a point adjacent said larger open end of said reflector.

5. The light projection system of claim 3, wherein the focal length of the lens is equal to, or less than, the distance from the light source to said lens positioned adjacent the mouth of said reflector.

6. The light projection system of claim 1, including a reflector aligned perpendicular to the longitudinal axis of the cone shaped reflector and positioned adjacent the apex focal point cross sectional area of said cone shaped reflector and at or near the base of the light source.

7. The light projection system of claim 1 wherein the apex focal point cross sectional area and the larger open end of the cone shaped reflector are configured to define a shape selected from the group of shapes consisting of round, elliptical, square, triangular, rectangular, and unconventional shapes, and said cone shaped reflector defines an overall shape transitioning from said apex focal point cross sectional area to said larger open end.

8. The light projection system of claim 1, wherein the reflector surfaces are coated with a material or made in a way that allows the infrared and heat energy of the light source to pass through and reflects a visible spectrum of the said light source.

9. The light projection system of claim 1, wherein the light source is selected from the group consisting of halogen, discharge, and semiconductor light sources.

10. The light projection system of claim 3, including a second lens aligned with the longitudinal axis of the cone shaped reflector, positioned at a point beyond the first lens, and with a focal length equal to or less than a distance from said second lens to a point adjacent said first lens.

11. The light projection system of claim 1, further comprising: a lamp base supporting the reflector system, a lens, the light source, and providing electrical power to said light source and an envelope attached to said lamp base to enclose said light source.

12. The light projection system of claim 11, wherein the said system further comprises:

a gate having an aperture adjacent the large open end of the cone shaped reflector and aligned with the longitudinal axis of said reflector;

a lens movable and positioned on the side of the gate opposite the reflector and light source;

wherein a substantial amount of the light emitted by the light source produces a vortex of light rays directed and reflected through the gate and to the lens to project a colluminated beam of light or image to a distant point.

13. The light projection system of claim 1, wherein the reflector is made of a thermally conductive metal or polymer and configured to be a heat sink.

14. The light projection system of claim 1, including a light emitting die package, comprising: a substrate having traces and one or more light emitting diodes (LEDs), or diode arrays mounted on said substrate, connected to said traces, and serving as the light source.

15. The light projection system of claim 14, wherein the LEDs are encapsulated within optically clear polymer made and shaped in a way to serve as a lens.

16. The light projection system of claim 14, wherein the substrate is made of a thermally conductive metal or polymer and configured to be a heat sink.

17. The light projection system of claim 14 further comprising an external heat sink coupled to the light source.

18. The light projection system of claim 14, wherein the substrate includes a square, triangular, rectangular, or octagonal mounting post carrying the one or more light emitting diodes (LEDs) or diode arrays and a height of the light source is not larger than a length or a width of said light source.

19. The light projection system of claim 18, wherein the mounting post is coupled to an external heat sink.

20. The light projection system of claim 14, wherein the cone shaped reflector defines a length that is not less than 1 times the diameter or cross sectional dimension of the larger open end of said reflector, and the one or more light emitting diodes (LEDs) or diode arrays emit light of a different color spectrum and are connected to different electrical circuits allowing said different color spectrum LEDs or diode arrays to be turned on and off, or output intensity controlled, separately.

* * * * *